US011684529B2

(12) United States Patent
Gibson et al.

(10) Patent No.: US 11,684,529 B2
(45) Date of Patent: Jun. 27, 2023

(54) MATTRESS COVER SENSOR METHOD

(71) Applicant: Hill-Rom Services, Inc., Batesville, IN (US)

(72) Inventors: Luke Gibson, Greensburg, IN (US); Keith R. Kubicek, Batesville, IN (US); James N. Hoffmaster, Batesville, IN (US); Timothy J. Receveur, Guilford, IN (US); Charles A. Lachenbruch, Batesville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 136 days.

(21) Appl. No.: 17/398,312

(22) Filed: Aug. 10, 2021

(65) Prior Publication Data

US 2021/0361502 A1 Nov. 25, 2021

Related U.S. Application Data

(60) Continuation of application No. 15/090,715, filed on Apr. 5, 2016, now abandoned, which is a division of application No. 14/190,972, filed on Feb. 26, 2014, now Pat. No. 9,333,136.

(60) Provisional application No. 61/770,679, filed on Feb. 28, 2013.

(51) Int. Cl.
*A61G 7/057* (2006.01)

(52) U.S. Cl.
CPC ..... *A61G 7/05776* (2013.01); *A61G 7/057* (2013.01); *A61G 7/05769* (2013.01); *A61G 2203/30* (2013.01); *A61G 2203/46* (2013.01)

(58) Field of Classification Search
CPC ..... A61G 7/05769; A61G 7/05776; A61G 7/057; A61G 2203/30; A61G 2203/32; A61G 2203/34; A61G 2203/36; A61G 2203/40; A61G 2203/44; A61G 2203/46; H05B 1/02; G01K 1/14
See application file for complete search history.

(56) References Cited

U.S. PATENT DOCUMENTS

| | | | |
|---|---|---|---|
| 3,325,799 | A | 6/1967 | Farris |
| 3,631,438 | A | 12/1971 | Lewin |
| 3,644,950 | A | 2/1972 | Lindsey, Jr. |
| 3,727,606 | A | 4/1973 | Sielaff |

(Continued)

FOREIGN PATENT DOCUMENTS

| | | |
|---|---|---|
| DE | 4018953 A1 | 1/1992 |
| EP | 862901 A1 | 9/1998 |

(Continued)

OTHER PUBLICATIONS

European Search Report for EP14156940, dated Aug. 8, 2014 (4 pages).

(Continued)

*Primary Examiner* — David R Hare
*Assistant Examiner* — Amanda L Bailey
(74) *Attorney, Agent, or Firm* — Barnes & Thornburg LLP

(57) ABSTRACT

A patient support apparatus includes a cushion, a cover arranged over a top side of the cushion, and a sensor unit. The sensor unit is coupled to the cover and arranged to underlie a patient supported on the cover. The sensor unit includes a sensor configured to detect conditions near the interface of a patient's skin with the cover.

20 Claims, 9 Drawing Sheets

(56) References Cited

U.S. PATENT DOCUMENTS 3,738,702 A 6/1973 Jacobs
3,836,900 A 9/1974 Mansfield
3,996,928 A 12/1976 Marx
4,146,885 A 3/1979 Lawson, Jr.
4,195,287 A 3/1980 McCoy et al.
4,245,651 A 1/1981 Frost
4,422,458 A 12/1983 Kravath
4,481,686 A 11/1984 Lacoste
4,483,029 A 11/1984 Paul
4,485,505 A 12/1984 Paul
4,525,885 A 7/1985 Hunt et al.
4,559,656 A 12/1985 Foster
4,564,965 A 1/1986 Goodwin
4,595,023 A 6/1986 Bonnet
4,602,643 A 7/1986 Dietz
4,637,083 A 1/1987 Goodwin
4,657,026 A 4/1987 Tagg
4,677,857 A 7/1987 Feldmann
4,681,098 A 7/1987 Lee
4,694,520 A 9/1987 Paul et al.
4,747,413 A 5/1988 Bloch
4,757,825 A 7/1988 Diamond
4,799,276 A 1/1989 Kadish
4,838,309 A 6/1989 Goodwin
4,907,132 A 3/1990 Parker
4,907,845 A 3/1990 Wood
4,934,468 A 6/1990 Koerber, Sr. et al.
4,935,968 A 6/1990 Hunt et al.
4,942,635 A 7/1990 Hargest et al.
4,949,412 A 8/1990 Goode
4,949,414 A 8/1990 Thomas et al.
4,971,065 A 11/1990 Pearce
5,010,772 A 4/1991 Bourland et al.
5,016,304 A 5/1991 Ryhiner
5,052,067 A 10/1991 Thomas et al.
5,057,819 A 10/1991 Valenti
5,060,174 A 10/1991 Gross
5,101,828 A 4/1992 Welkowitz et al.
5,117,518 A 6/1992 Schild
5,170,364 A 12/1992 Gross et al.
5,182,826 A 2/1993 Thomas et al.
5,184,112 A 2/1993 Gusakov
5,276,432 A 1/1994 Travis
5,283,735 A 2/1994 Gross et al.
5,493,742 A 2/1996 Klearman
5,539,942 A 7/1996 Melou
5,588,167 A 12/1996 Pahno et al.
5,664,270 A 9/1997 Bell et al.
5,794,288 A 8/1998 Soltani et al.
5,800,480 A 9/1998 Augustine et al.
5,802,611 A 9/1998 McKenzie et al.
5,815,864 A 10/1998 Sloop
5,829,081 A 11/1998 Pearce
5,873,137 A 2/1999 Yavets-Chen
5,881,410 A 3/1999 Yamada
5,934,280 A 8/1999 Viard et al.
5,964,720 A 10/1999 Pelz
6,009,580 A 1/2000 Caminade et al.
6,011,477 A 1/2000 Teodorescu et al.
6,033,432 A 3/2000 Augustine et al.
6,034,526 A 3/2000 Montant et al.
6,052,049 A 4/2000 Blakesley
6,067,019 A 5/2000 Scott
6,079,068 A 6/2000 Viard
6,080,690 A 6/2000 Lebby et al.
6,094,762 A 8/2000 Viard et al.
6,208,250 B1 3/2001 Dixon et al.
6,212,718 B1 4/2001 Stolpmann et al.
6,386,051 B1 5/2002 Yoshimi et al.
6,493,568 B1 12/2002 Bell et al.
6,497,720 B1 12/2002 Augustine et al.
6,560,804 B2 5/2003 Wise et al.
6,719,708 B1 4/2004 Jansen
6,721,980 B1 4/2004 Price et al.
6,730,115 B1 5/2004 Heaton
6,739,006 B2 5/2004 Borders et al.
6,813,790 B2 11/2004 Flick et al.
6,923,571 B2 8/2005 Ellenz
6,984,207 B1 1/2006 Sullivan et al.
7,077,810 B2 7/2006 Lange et al.
7,090,648 B2 8/2006 Sackner et al.
7,107,642 B2 9/2006 Wong et al.
7,111,346 B2 9/2006 Inman et al.
7,127,948 B2 10/2006 Tavares et al.
7,183,930 B2 2/2007 Basir et al.
7,219,380 B2 5/2007 Beck et al.
7,228,576 B2 6/2007 Inman et al.
7,242,306 B2 7/2007 Wildman et al.
7,248,933 B2 7/2007 Wildman
7,253,366 B2 8/2007 Bhai
7,273,490 B2 9/2007 Lachenbruch
7,296,312 B2 11/2007 Menkedick et al.
7,304,580 B2 12/2007 Sullivan et al.
7,306,564 B2 12/2007 Nakatani et al.
7,314,451 B2 1/2008 Halperin et al.
7,315,535 B2 1/2008 Schuman
7,316,171 B2 1/2008 Nemoto
7,319,386 B2 1/2008 Collins, Jr. et al.
7,330,127 B2 2/2008 Price et al.
7,409,735 B2 8/2008 Kramer et al.
7,459,645 B2 12/2008 Skinner et al.
7,472,439 B2 1/2009 Lemire et al.
7,515,059 B2 4/2009 Price et al.
7,629,890 B2 12/2009 Sullivan et al.
7,714,238 B2 5/2010 Skinner et al.
7,787,726 B2 8/2010 Ten Eyck et al.
7,825,814 B2 11/2010 Lokhorst et al.
8,087,113 B2 1/2012 Roff et al.
8,327,477 B2 12/2012 Lachenbruch et al.
8,525,679 B2 9/2013 Riley et al.
8,531,307 B2 9/2013 Lachenbruch
8,578,527 B2 11/2013 Lachenbruch et al.
8,672,853 B2 3/2014 Young
9,149,211 B2 * 10/2015 Mravyan ..... A61G 5/1043
9,333,136 B2 5/2016 Gibson et al.
2001/0001235 A1 5/2001 Menkedick et al.
2003/0033675 A1 * 2/2003 Solesbee ..... A61G 13/0018 5/694
2003/0210144 A1 11/2003 Ott
2004/0111045 A1 6/2004 Sullivan et al.
2005/0027416 A1 2/2005 Basir et al.
2005/0076715 A1 * 4/2005 Kuklis ..... A61B 5/1126 73/541
2005/0168341 A1 8/2005 Reeder et al.
2005/0190062 A1 9/2005 Sullivan et al.
2005/0190068 A1 9/2005 Gentry et al.
2005/0288749 A1 12/2005 Lachenbruch
2006/0021141 A1 2/2006 Shima
2006/0085919 A1 4/2006 Kramer et al.
2006/0101581 A1 5/2006 Blanchard et al.
2006/0109091 A1 5/2006 Rittmueller et al.
2006/0162074 A1 7/2006 Bader
2006/0179952 A1 8/2006 Tavares et al.
2007/0057665 A1 3/2007 Borst et al.
2007/0083125 A1 4/2007 Ouchi et al.
2007/0118038 A1 5/2007 Bodecker et al.
2007/0118054 A1 5/2007 Pinhas et al.
2007/0118993 A1 5/2007 Bates
2007/0135878 A1 6/2007 Lachenbruch et al.
2007/0176092 A1 8/2007 Miller et al.
2007/0241895 A1 10/2007 Morgan
2007/0261548 A1 11/2007 Vrzalik et al.
2008/0015665 A1 1/2008 Lachenbruch
2008/0028533 A1 2/2008 Stacy et al.
2008/0060138 A1 3/2008 Price et al.
2008/0079697 A1 4/2008 Lee et al.
2008/0109964 A1 5/2008 Flocard et al.
2008/0114260 A1 5/2008 Lange et al.
2008/0169931 A1 7/2008 Gentry et al.
2008/0269625 A1 10/2008 Halperin et al.
2008/0275349 A1 11/2008 Halperin et al.
2009/0193573 A1 * 8/2009 Nakamura ..... A61G 7/02 4/320
2009/0217460 A1 9/2009 Bobey et al.

(56) References Cited

U.S. PATENT DOCUMENTS

| | | | | |
|---|---|---|---|---|
| 2010/0043143 | A1 | 2/2010 | O'Reagan et al. | |
| 2010/0101022 | A1 | 4/2010 | Riley et al. | |
| 2010/0101026 | A1 | 4/2010 | Papaioannou | |
| 2010/0132116 | A1 | 6/2010 | Stacy et al. | |
| 2010/0274331 | A1 | 10/2010 | Williamson et al. | |
| 2011/0024076 | A1* | 2/2011 | Lachenbruch | A61G 7/057 165/48.1 |
| 2011/0068939 | A1 | 3/2011 | Lachenbruch | |
| 2011/0113561 | A1 | 5/2011 | Douglas | |
| 2011/0163885 | A1 | 7/2011 | Poulos et al. | |
| 2011/0247143 | A1 | 10/2011 | Richards et al. | |
| 2012/0172959 | A1 | 7/2012 | Lachenbruch et al. | |
| 2012/0174322 | A1 | 7/2012 | Skinner et al. | |
| 2012/0191164 | A1 | 7/2012 | Gander et al. | |
| 2013/0013022 | A1 | 1/2013 | De Oliveira Barroso Júnior | |
| 2013/0019405 | A1 | 1/2013 | Flanagan et al. | |
| 2013/0135137 | A1 | 5/2013 | Mulder et al. | |
| 2013/0269106 | A1 | 10/2013 | Brykalski et al. | |
| 2014/0018205 | A1 | 1/2014 | Takaishi et al. | |
| 2014/0182051 | A1 | 7/2014 | Tanimoto et al. | |
| 2014/0237722 | A1 | 8/2014 | Gibson et al. | |
| 2015/0059100 | A1 | 3/2015 | Brubaker et al. | |
| 2016/0213539 | A1 | 7/2016 | Gibson et al. | |

FOREIGN PATENT DOCUMENTS

| | | | |
|---|---|---|---|
| EP | 1779824 | A2 | 5/2007 |
| EP | 2298264 | A2 | 3/2011 |
| EP | 2508128 | A1 | 10/2012 |
| EP | 2667313 | A2 | 11/2013 |
| JP | 6315424 | A | 2/2016 |
| WO | 1986005965 | A1 | 10/1986 |
| WO | 2000024353 | A1 | 5/2000 |
| WO | 2004045407 | A1 | 6/2004 |
| WO | 2006023479 | A2 | 3/2006 |
| WO | 2007008831 | A2 | 1/2007 |
| WO | 2007016054 | A2 | 2/2007 |

OTHER PUBLICATIONS

For Collins English Dictionary: Incontinent (n.d.) Collins English Dictionary—Complete and Unabridged, 12$^{th}$ Edition 2014. (1991, 1994, 1998, 2000, 2003, 2006, 2007, 2009, 2011, 2014). Retrieved Jul. 20, 2021, from https://www.thefreedictionary.com/incontinent (Year: 1991).

Gupta, Nikita. "Humidity Sensor: Basics, Usage, Parameters and Applications." Dec. 15, 2020, https://www.electronicsforu.com/tech-zone/electronics-components/humidity-sensor-basic-usage-parameter. Accessed Jul. 21, 2012. (Year: 2020).

* cited by examiner

MATTRESS COVER SENSOR METHOD

This application is a continuation of U.S. application Ser. No. 15/090,715, filed Apr. 5, 2016, which is a divisional of U.S. application Ser. No. 14/190,972, filed Feb. 26, 2014, now U.S. Pat. No. 9,333,136, and which claimed the benefit, under 35 U.S.C. § 119(e), of U.S. Provisional Application No. 61/770,679, filed Feb. 28, 2013, each of which is hereby incorporated by reference herein in its entirety.

BACKGROUND

The present disclosure is related to patient supports, and in particular to patient supports with sensors. More specifically, the present disclosure is related to a patient support apparatus including at least one sensor for detecting conditions at the interface of the patient support apparatus and a patient positioned on the patient support apparatus.

Bed sores, sometimes called pressure ulcers or decubitus ulcers, are a common type of skin breakdown experienced by patients. Conditions at the interface of a patient support apparatus and a patient's skin may be considered when determining a risk level for bed sore formation. Conditions evaluated at the interface of a patient support apparatus and a patient's skin that may be considered include moisture, temperature, skin health, and the like.

Some care centers implement manual routines for checking conditions at the interface of a patient support apparatus and a patient's skin in order to determine a risk level for bed sores. The determined risk levels can then be used to schedule therapies to mitigate the risk of bed sore formation. Such manual checks may not be performed with great frequency in some care centers on account of low staffing or high occupancy.

SUMMARY

The present application discloses one or more of the features recited in the appended claims and/or the following features which, alone or in any combination, may comprise patentable subject matter:

A patient support apparatus may include a cushion, a cover, and a sensor unit. The cover may overlie the cushion and may be configured to support a patient. The sensor unit may be coupled to the cover.

In some embodiments, the cover may be formed to include a slit. The sensor unit may include a sensor and a flexible mount coupled to the sensor. The flexible mount may be inserted through the slit formed in the cover to couple the sensor unit to the cover.

The flexible mount may include a stem portion and a retention portion. The stem portion may be inserted through the slit while the retention portion engages the cover along the slit to retain the sensor in place relative to the cover.

In some embodiments, the retention portion may be U-shaped. In other embodiments, the retention portion is V-shaped or triangular.

In some embodiments, the flexible mount may include a flexible film and a circuit. The circuit may be coupled to the flexible film to provide an electrical path from the sensor.

In some embodiments, the cover may include a top layer, a middle layer, and a bottom layer. The slit formed in the cover may extend through the top layer of the cover. The middle layer may be made of a three-dimensional material configured to conduct air between the top layer and the bottom layer.

In some embodiments, the patient support apparatus may also include an air box. The air box may be coupled to the cover and may be configured to provide air to the middle layer of the cover. The air box may include a blower and a controller. The blower may be coupled to the middle layer of the cover. The controller may be coupled to the blower and to the sensor unit. The controller may be configured to adjust operation of the blower based on information from the sensor unit.

In some embodiments, the cushion includes a plurality of inflatable bladders. It is contemplated that the patient support apparatus may also include a lower ticking coupled to the cover to encase the plurality of inflatable bladders.

In some embodiment, the patient support apparatus may also include an air box. The air box may include a blower and a controller. The blower may be coupled to the plurality of inflatable bladders. The controller may be coupled to the sensor unit and the blower. The controller may be configured to adjust the operation of the blower based on information from the sensor unit.

In some embodiments, the sensor unit may be located in a central portion of the cover. The central portion of the cover may be situated between a head end and a foot end of the cover so that the sensor unit is arranged to underlie the pelvic region of a patient.

According to another aspect of the present disclosure, a patient support apparatus may include a cushion, a cover and a wireless sensor unit. The cover may overlie a top side of the cushion and may be configured to support a patient.

In some embodiments, the wireless sensor unit may be configured to detect moisture and may be coupled to the cover between a head end and a foot end of the cover. The wireless sensor unit may be located in a central region of the cover to underlie a patient's pelvic area when a patient is lying on the cover.

In some embodiments, the cover may be a topper overlying the top side of the cushion. The topper may be configured to conduct air along the top side of the surface.

In some embodiments, the patient support apparatus may also include an air box including a blower and a controller. The blower may be coupled to the topper. The controller may be coupled to the blower and may be in wireless communication with the wireless sensor unit. The controller may be configured to adjust the operation of the blower to change the amount of air provided to the topper based on information received from the sensor unit.

In some embodiments, the cushion may include a plurality of inflatable bladders. The patient support apparatus may include an air box including a blower and a controller. The blower may be coupled to the plurality of inflatable bladders. The controller may be coupled to the blower and may be in wireless communication with the wireless sensor unit. The controller may be configured to operate the blower to adjust the pressure in the plurality of inflatable bladders based on information received from the wireless sensor unit.

In some embodiments, the wireless sensor unit may be passive. The patient support apparatus may include a reader spaced apart from the wireless sensor unit. The reader may be configured to power the sensor unit and to receive data from the wireless sensor unit. The reader may be arranged to underlie the wireless sensor unit.

In some embodiments, the patient support apparatus may include a frame including deck and a base. The deck may underlie the cushion and the cover. The base may underlie the deck to support the deck above a floor. The reader may be coupled to the deck.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
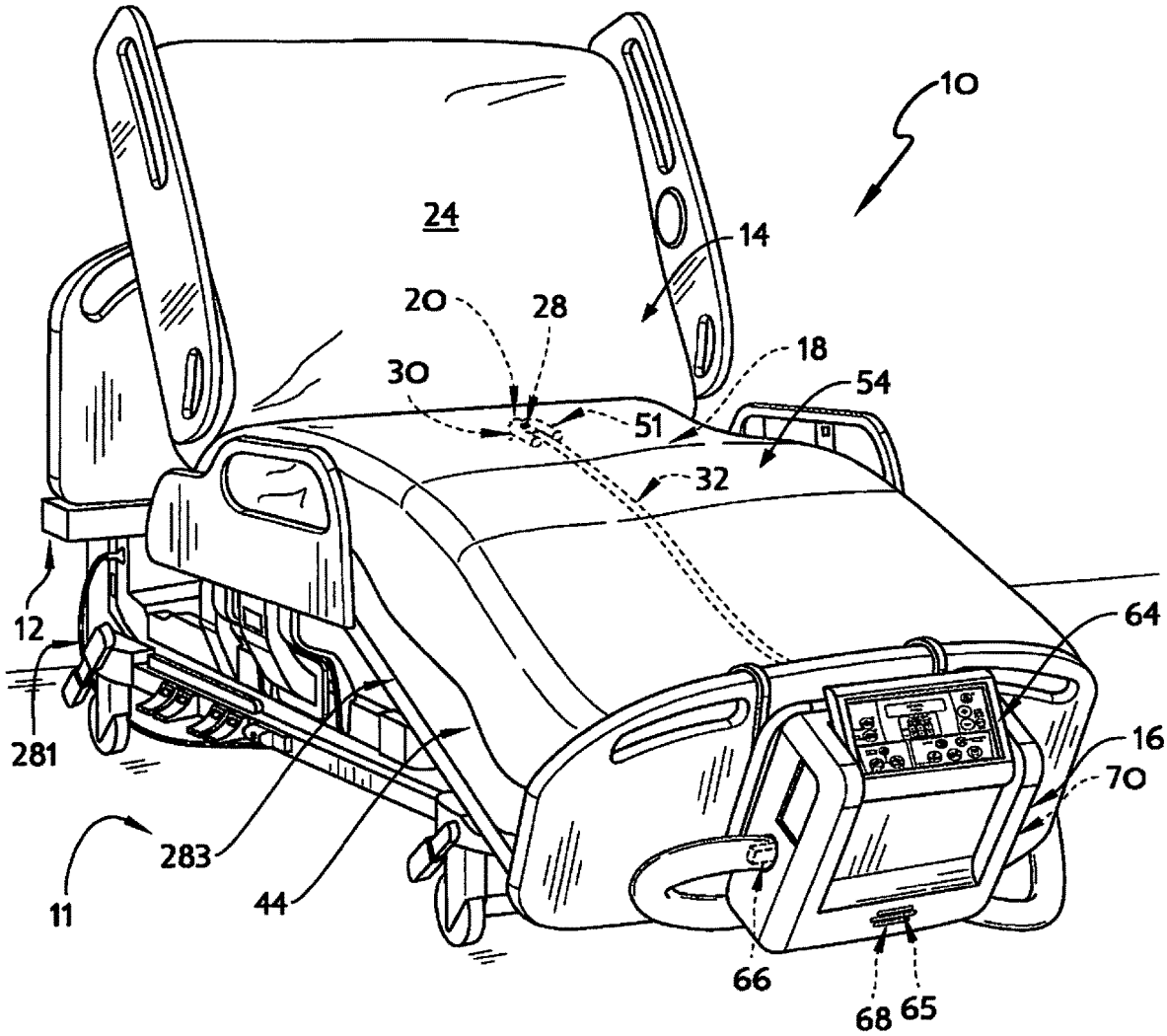
FIG. 1 is a perspective view of a patient support apparatus including a support frame, a support surface with a sensor unit, and an air box pneumatically coupled to the support surface.

An illustrative patient support apparatus 10 includes a frame 12, a support surface 14 mounted on the frame 12, and an air box 16 coupled to the support surface 14. The support surface 14 illustratively includes a topper 18 and a sensor unit 20 coupled to the topper 18 (sometimes called a cover). Both the topper 18 and the sensor unit 20 are located adjacent to a top side 24 of the support surface 14. The sensor unit 20 is configured to detect conditions at the interface of the support surface 14 and a patient positioned on the patient support apparatus 10.

The illustrative sensor unit 20 is configured to detect moisture levels at the interface of the patient support apparatus 10 and a patient's skin, for example from sweat or incontinence. In some embodiments, the sensor unit 20 may be configured to detect conditions other than moisture such as temperature, pressure, or the like.

Figure 9:
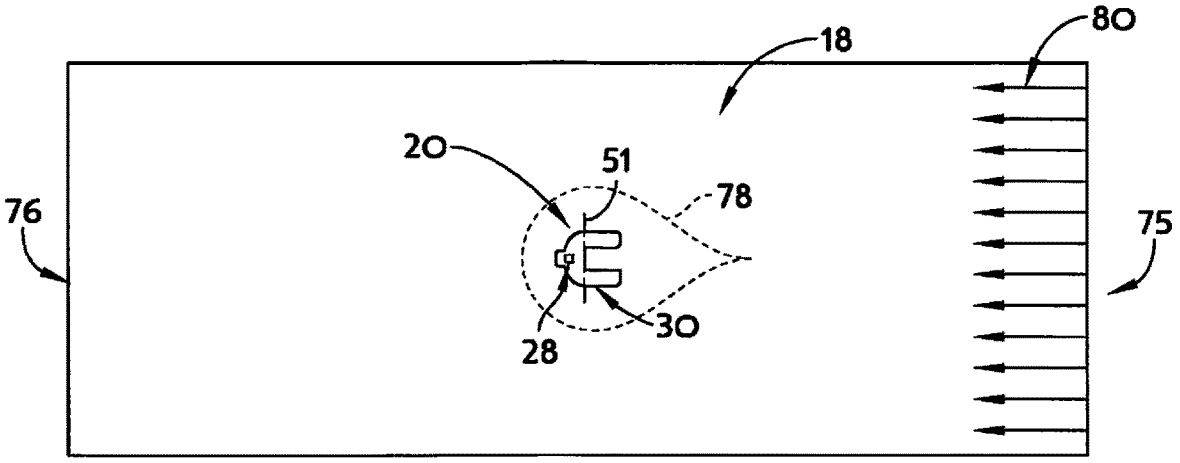
FIG. 9 is a top plan view of the support surface of FIGS. 1 and 2 with the sensor unit arranged to underlie a patient's pelvic region.

The topper 18 is configured to conduct air along the top side 24 of the support surface 14 along the interface of a patient's skin with the support surface 14 to carry away moisture from the patient as suggested in FIG. 9. Based on input from the sensor unit 20, the air box 16 is configured to take action to reduce the risk of pressure sore formation, for example triggering an alarm to request caregiver intervention or adjusting the air provided to the topper 18.

Figure 2:
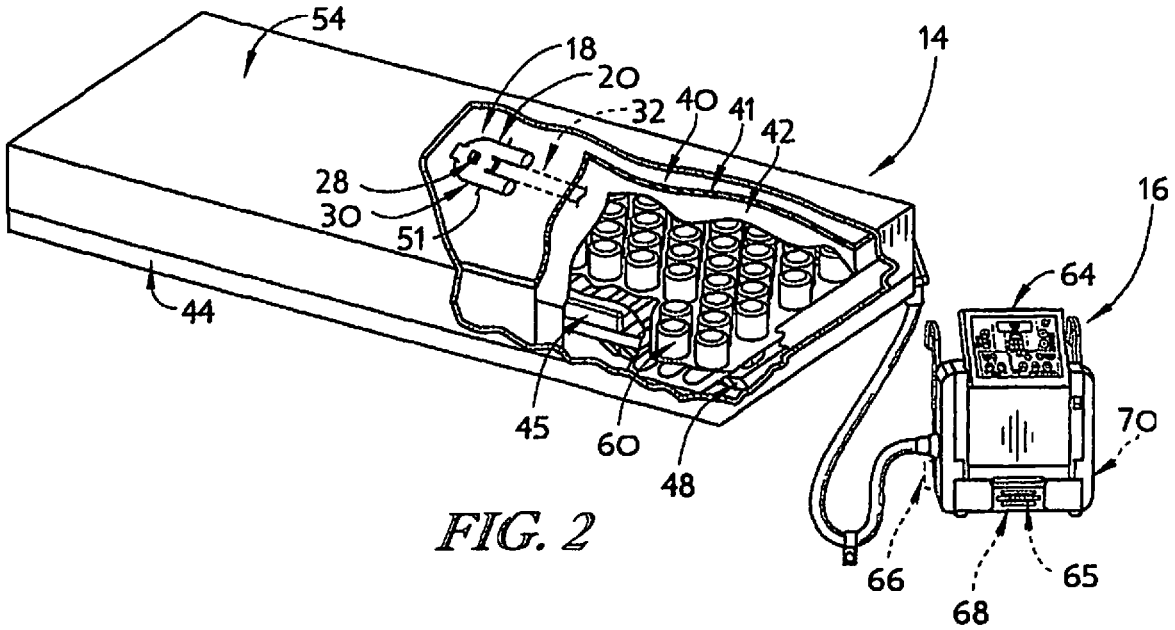
FIG. 2 is a cut-away perspective view of the support surface and the air box of FIG. 1 showing that the sensor unit is coupled to a topper included in the support surface located beneath a coverlet included in the support surface.
Figure 3:
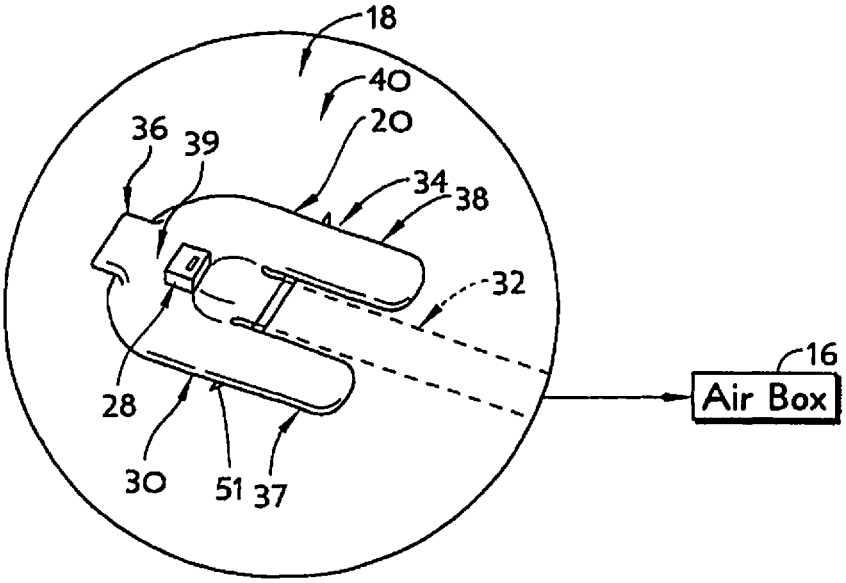
FIG. 3 is a detail view of the moisture sensor of FIG. 2 with the moisture sensor unit inserted into a slit formed in the topper of the support surface to removably couple the sensor unit to the topper so that the sensor unit can be removed during cleaning of the topper.

In the illustrative embodiment, the sensor unit 20 includes a sensor 28 and a flexible mount 30 as shown in FIGS. 2 and 3. The sensor 28 is configured to detect moisture and is coupled to the flexible mount 30. The flexible mount 30 in is a flexible polymeric film with a circuit integrated into to the flexible polymer film to provide an electrical path from the sensor 28 to the air box 16 as suggested in FIG. 3.

In some embodiments, the flexible mount 30 may be a flexible textile with an integrated circuit (not shown) that is sewn or adhered to the topper 18. Illustrative textiles with integrated power and data circuits are available from Weel Technologies of Guangdong, China. The compliance of flexible mount 30 included in the sensor unit 20 (whether polymeric film or textile) may make lying on the sensor unit 20 more comfortable for a patient lying on the support surface 14 than if the sensor unit 20 included other rigid components and/or connectors.

The flexible mount 30 is illustratively shaped to include a stem portion 32, a retention portion 34, and a tab portion 36 as shown, for example, in FIG. 3. The stem portion 32 is sized to extend from the retention portion 34 to the air box 16. The retention portion 34 is U-shaped with two legs 37, 38 located on opposite sides of the stem portion 32 that are interconnected by an arcuate cross-member 39 as shown in FIG. 3. The cross-member 39 of the retention portion 34 intersects the stem portion 32 as shown in FIG. 3. In the illustrative embodiment, the sensor 28 is coupled the retention portion 34. The tab portion 36 illustratively extends from the retention portion 34 away from the stem portion 32.

Figure 4:
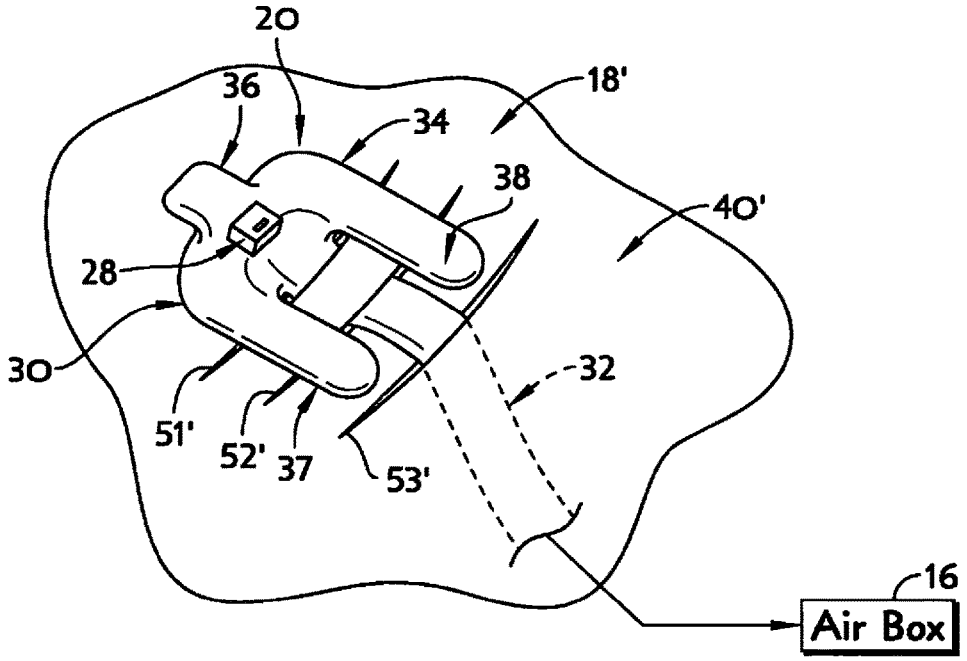
FIG. 4 is a view similar to FIG. 3 for another embodiment of the support surface of FIGS. 1 and 2 with the sensor unit woven through two slits formed in the topper of the support surface to removably couple the moisture sensor unit to the topper.

When the sensor unit 20 is coupled to the topper 18, the stem portion 32 is inserted under a top layer 40 of the topper 18 through a slit 51 formed in the top layer 40 of the topper 18 as shown in FIG. 3. The retention portion 34 remains above the top layer 40 of the topper 18 and engages the top layer 40 along the slit 51 to retain the sensor 28 of the sensor unit 20 at a predetermined location relative to the topper 18 as suggested in FIGS. 2 and 3. In an alternative embodiment, the stem portion 32 may be woven through three slits 51', 52', 53' formed in a top layer 40' of a topper 18' as shown in FIG. 4. In some embodiments, the sensor unit 20 may be coupled to other sheets or covers extending over at least a portion of the top side 24 of the support surface 14 via insertion of the stem portion 32 through a slit formed in the cover.

Coupling of the sensor unit 20 to the topper 18 via insertion of the stem portion 32 into the slit 51 until further insertion is blocked by contact of the retention portion 34 with the topper 18 as suggested in FIGS. 2 and 3 allows for predetermined placement of the sensor 28 relative to the topper 20. Providing repeatable placement of the sensor 28 during coupling allows for repeated removal and recoupling of the sensor unit 20 by users. Thus, the sensor unit 20 may be removed for regular washing of the topper 18 so that the sensor 28 and the flexible mount 30 are not exposed to water or cleaning chemicals.

Figure 5:
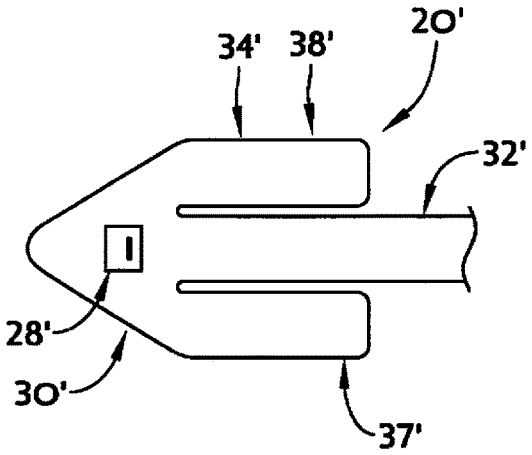
FIG. 5 is a top plan view of a first alternative sensor unit for use in the patient support apparatus of FIGS. 1-4.
Figure 6:
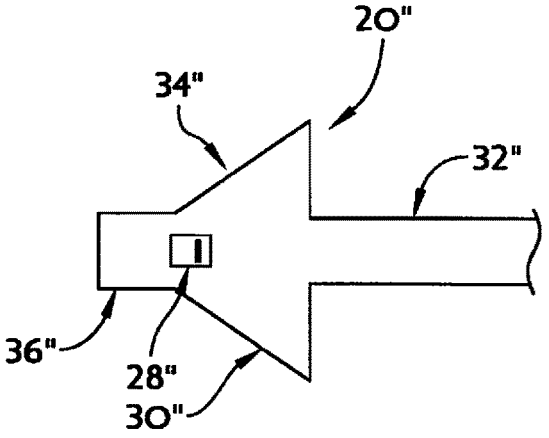
FIG. 6 is a top plan view of a second alternative sensor unit for use in the patient support apparatus of FIGS. 1-4.

Referring briefly to FIGS. 5 and 6, alternative sensor units 20' and 20" are shown. The first alternative sensor unit 20' is substantially similar to sensor unit 20 except that the retention portion 34' is arrow-shaped with two legs 37', 38' on either side of the stem 32' interconnected by a triangular cross-member 39' as shown in FIG. 5. Further, the first alternative sensor unit 20' does not include a tab. The second alternative sensor unit 20" is also similar to sensor unit 20 except that retention portion 34" is triangular as shown in FIG. 6. The retention portion 34" is illustratively sized to extend beyond the width of the slit 51 formed in the topper 18 to block the retention portion 34" and the sensor 28" of the sensor unit 20" from being pushed through the slit 51.

Figure 7:
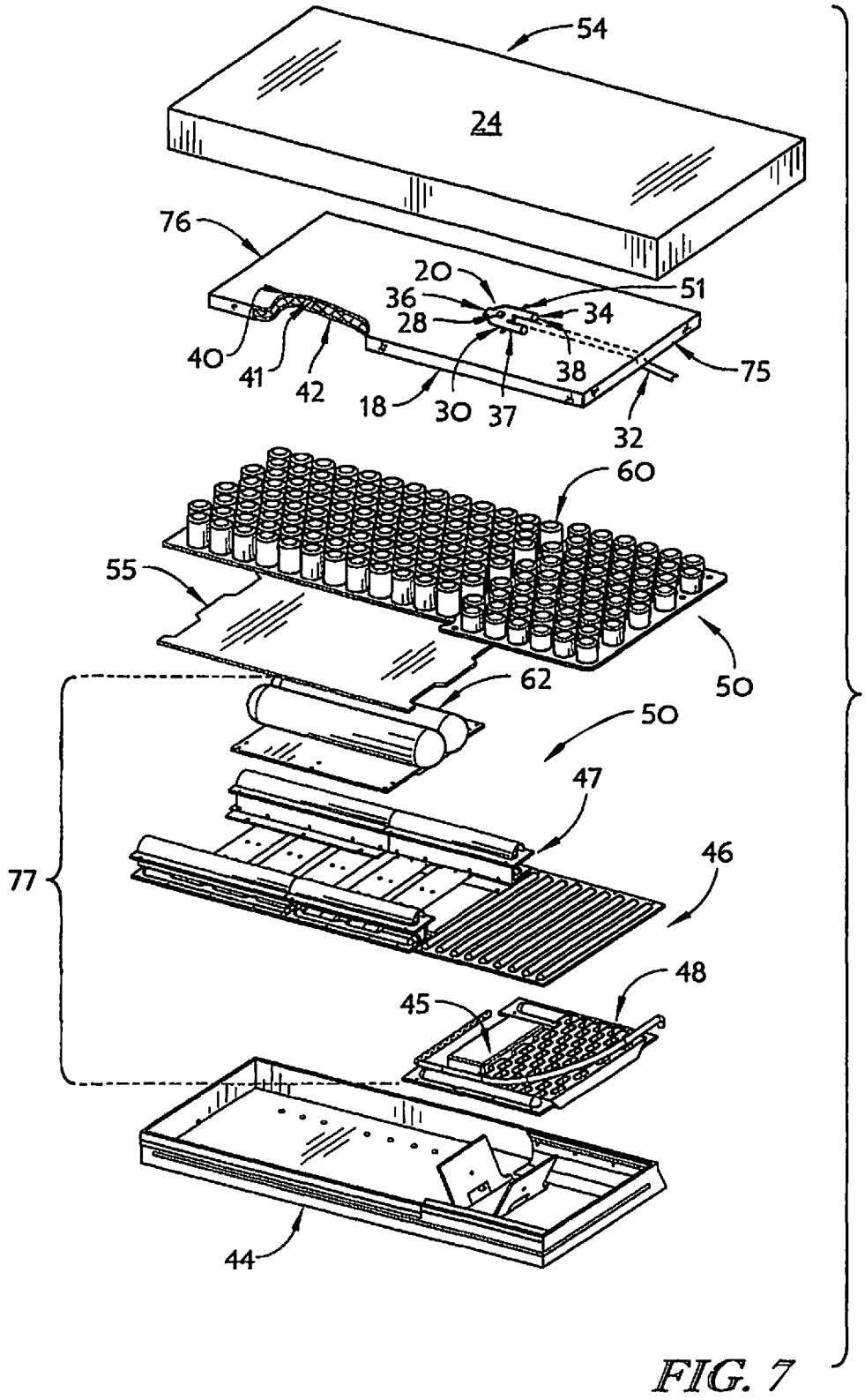
FIG. 7 is an exploded perspective view of the support surface of FIGS. 1 and 2 showing that the support surface includes a lower ticking, a number of foam bodies, a valve box, a number of inflatable bladders, a fire barrier, the topper, the sensor unit coupled to the topper, and a coverlet.

Turning now to FIG. 7, the exemplary topper 18 is shown to include a middle layer 41 and a bottom layer 42 in addition to the top layer 40. The top layer 40 and the bottom layer 42 are illustratively sheets constructed from a vapor-permeable, liquid impermeable material. More particularly, the top layer 40 and the bottom layer 42 are illustratively sheets of urethane coated nylon available from Uretek of New Haven, Conn. The middle layer 41 of the topper 18 is illustratively a sheet made from a three-dimensional material. The illustrative three-dimensional material used is sold under the name PRESSLESS® from Bodet & Horst and is configured to maintain an air gap between the top layer 40 and the bottom layer 42 when a patient is lying on the topper 18. The bottom layer 42 is a sheet constructed from vapor-impermeable, liquid impermeable material. Air from the air box 16 is conducted though the middle layer 41 of the topper 18 to pull moisture away from a patient supported on the topper 18.

In addition to the topper 18 and the sensor unit 20, the illustrative support surface 14 includes a lower ticking 44, a valve box 45, foam components 46, inflatable bladders 50, a rigid sheet 55, and upper ticking 54 as shown in FIG. 7. The lower ticking 44 cooperates with the upper ticking 54 to form a cover that encases the other components of the support surface 14. The valve box 45 is pneumatically coupled to the inflatable bladders 50 and the topper 18 to distribute air to the bladders 50 and the topper 18.

The foam components 46 include a foam shell 47 and a foot-section filler pad 48 as shown in FIG. 7. The inflatable bladders 50 include support bladders 60 and turn bladders 62. The foam shell 47, foot-section filler pad 48, support bladders 60, and turn bladders 62 cooperate to provide a cushion 77 that supports a patient lying on the patient support apparatus 10. In some embodiments, the support surface 14 may also include a coverlet (not shown) that forms a cover for the other components of the support surface 14 and/or a fire sock 58 (shown diagrammatically in FIG. 8) that encases the internal components of the support surface 14.

Figure 8:
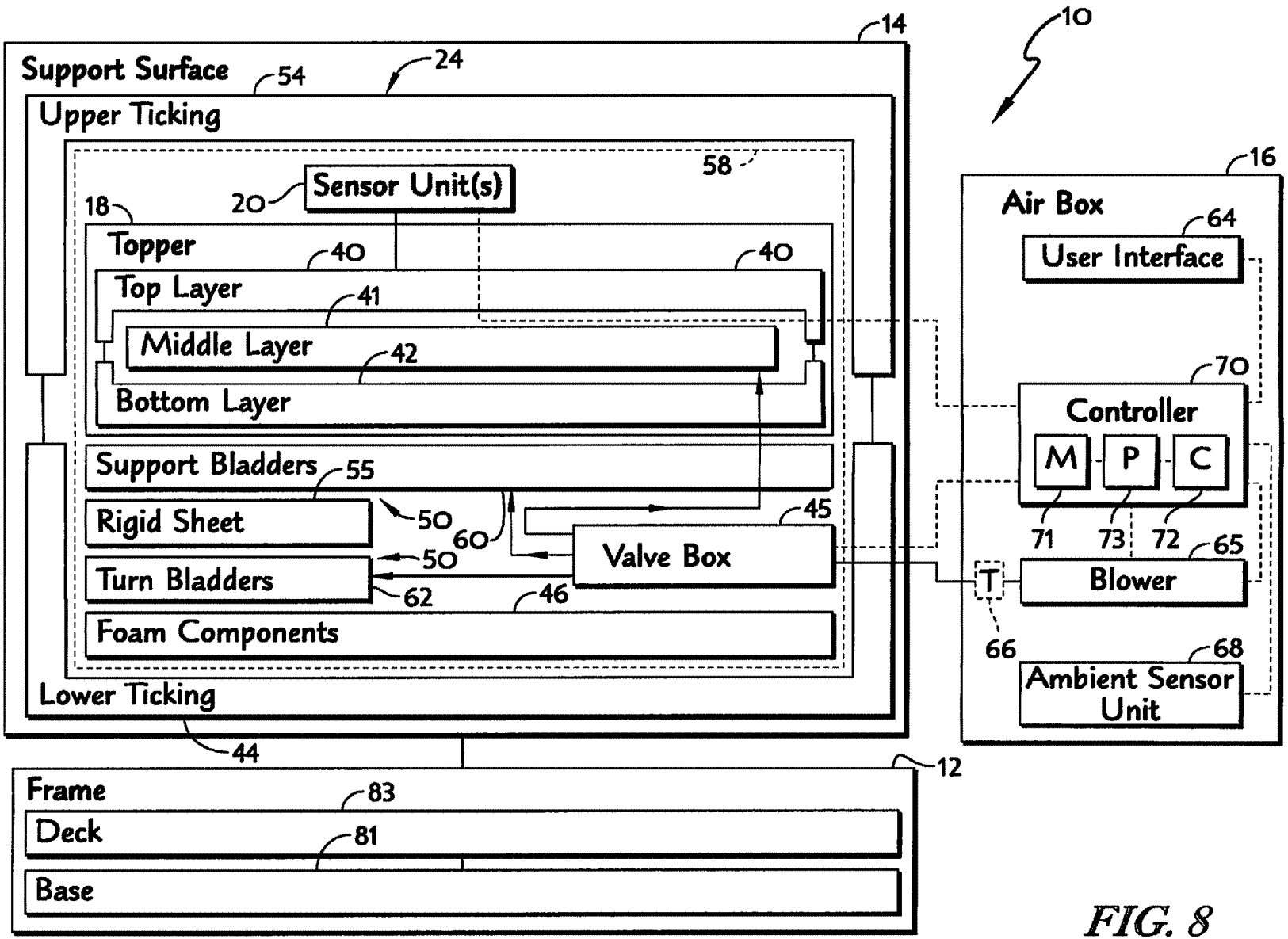
FIG. 8 is a block diagram of the patient support apparatus of FIG. 1 showing that the air box includes a user interface, a blower, and a controller that is coupled to the moisture sensor unit, the valve box and to the blower so that the controller can adjust air supplied to the topper and the inflatable bladders in response to inputs from the sensor unit.

Turning now to FIG. 8, the connection of the air box 16 to the frame 12 and the support surface 14 is shown diagrammatically. The air box 16 includes a user interface 64, a blower 65, an ambient sensor unit 68, and a controller 70 coupled to the rest of the air box components 64, 65, 68. The user interface 64 illustratively includes a number of push buttons and an LCD display that allow a user to set operating parameters of the air box 16. In other embodiments, the user interface 64 may be a touch-screen display or another suitable user input device. The blower 65 is pneumatically coupled to the valve box 45 to provide pressurized air to the inflatable bladders 50 and to the topper 18. The ambient sensor unit 68 is configured to detect environmental conditions including relative humidity, temperature, and pressure that is used by the controller 70 to evaluate moisture detected by the sensor unit 20 in the support surface 14. In addition to the other components of the air box 16, the controller 70 is also coupled to the sensor unit 20 and to the valve box 45 of the support surface 14 as shown in FIG. 8. In some embodiments, the air box 16 may also include sensor 66 coupled to the output of the blower 65 configured to detect the temperature of the air supplied to the support surface 14.

The illustrative controller 70 includes a memory 71, a clock 72, and a processor 73. The memory 71 is configured to hold instructions and data for use by the processor 73. The clock 72 is coupled to the processor 73 to provide time stamps to the processor 73. The processor 73 executes the instructions on the memory 71 and writes information to the memory 71, for example, adjusting operation of the blower 65 and valve box 45 based on inputs received from the sensor unit 20, the ambient sensor unit 68, and the sensor 66 as proscribed by the instructions written in the memory 71.

In operation, the controller 70 receives moisture data (and sometimes temperature data) corresponding to conditions adjacent to a patient's skin from the sensor unit 20 and moisture data (and sometimes temperature data) corresponding to atmospheric conditions from the ambient sensor unit 68. Based on the received data, the controller 70 determines a risk level for developing bed sores.

If the risk level exceeds one or more predetermined thresholds stored in the memory 71, the controller 70 takes one or more corresponding corrective actions. Corrective actions may include displaying an alert on the user interface 64, sending an alert to a caregiver via a nurse call (or similar) system, and/or adjusting the operation of the blower 65 and the valve box 45 to increase air flow through the topper 18, to change the pressure in the support bladders 60, and/or to start lateral rotation of the patient using the turn bladders 62.

In the illustrative embodiment, the frame 12 includes a base 81 and a deck 83 as shown in FIGS. 1 and 8. The base 81 supports the deck 83 and the support surface 14 above a floor 11. The deck 83 underlies the support surface 14 and is reconfigurable to a plurality of positions including a lie-flat position and a sitting-up position (shown in FIG. 1). In some embodiments, the air box 16 may be integrated into the frame 12 as suggested in FIGS. 14 and 15.

In FIG. 9, a top view of topper 18 and the sensor unit 20 showing that the sensor 28 of the sensor unit 20 (and the slit 51) is located between a head end 75 and a foot end 76 of the topper 18. A detection zone 78 corresponding to an exemplary area of effectiveness for the sensor unit 20 is drawn around the sensor 28. In the illustrative embodiment, the detection zone 78 is arranged to lie under a patient's pelvic region when the patient is lying or sitting on the topper 18. Also, a series of flow lines 80 indicate that flow through the topper 18 originates across the entire width of the topper 18 near the foot end 76 of the topper 18 and moves toward the head end 75 of the topper 18.

Figure 10:
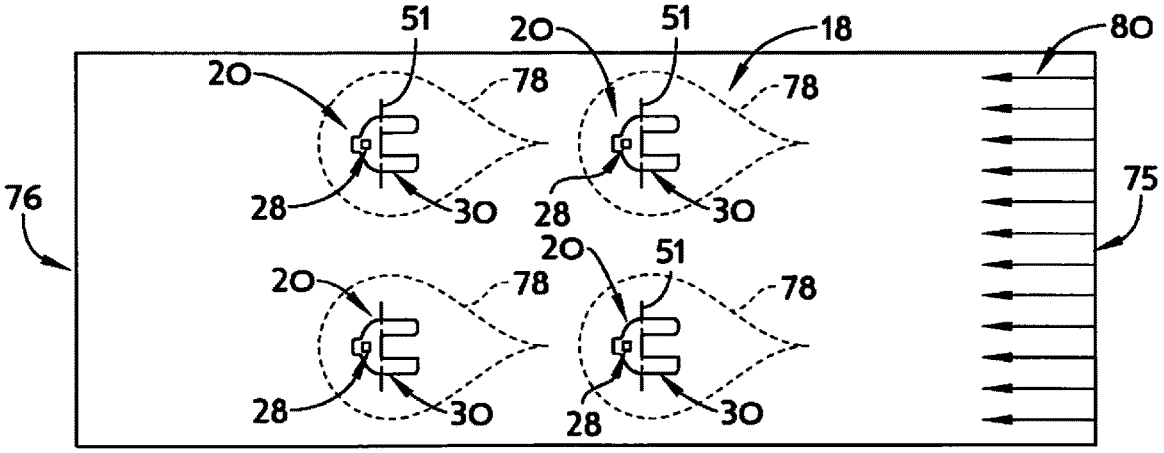
FIG. 10 is a view similar to FIG. 9 for another embodiment of the support surface with four sensor units included in the support surface arranged to underlie a patient's pelvic region and torso region.
Figure 11:
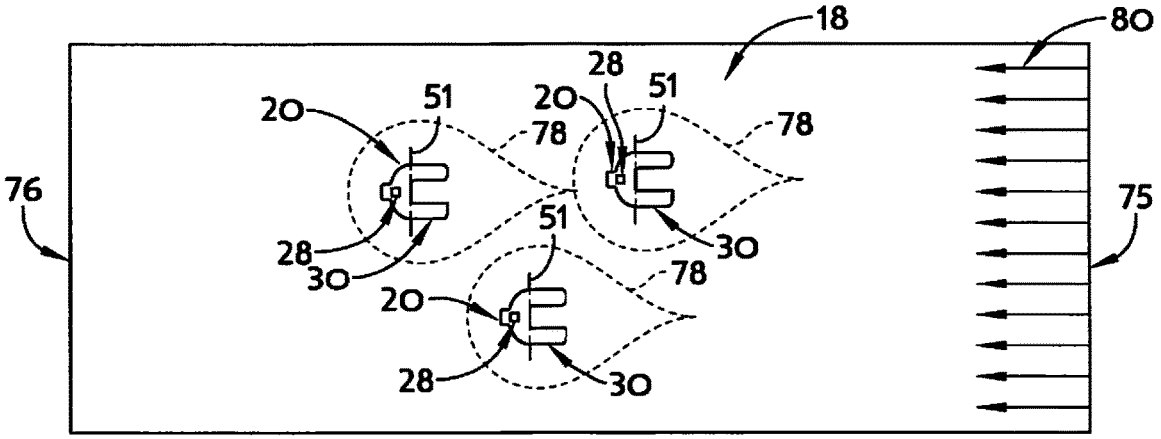
FIG. 11 is a view similar to FIGS. 9 and 10 for another embodiment of the support surface with three sensor units included in the support surface arranged to underlie a patient's pelvic region and torso region.

In FIGS. 10-11 alternative embodiments including more than one sensor units 20 coupled to the topper 18 are shown. Particularly, FIG. 10 shows an alternative arrangement with four sensor units 20 arranged in a rectangle to detect moisture under a patient's pelvic region and a patient's torso region. FIG. 11 shows an alternative arrangement with three sensor units 20 arranged in a triangle to detect moisture under a patient's pelvic region and a patient's torso region.

Figure 12:
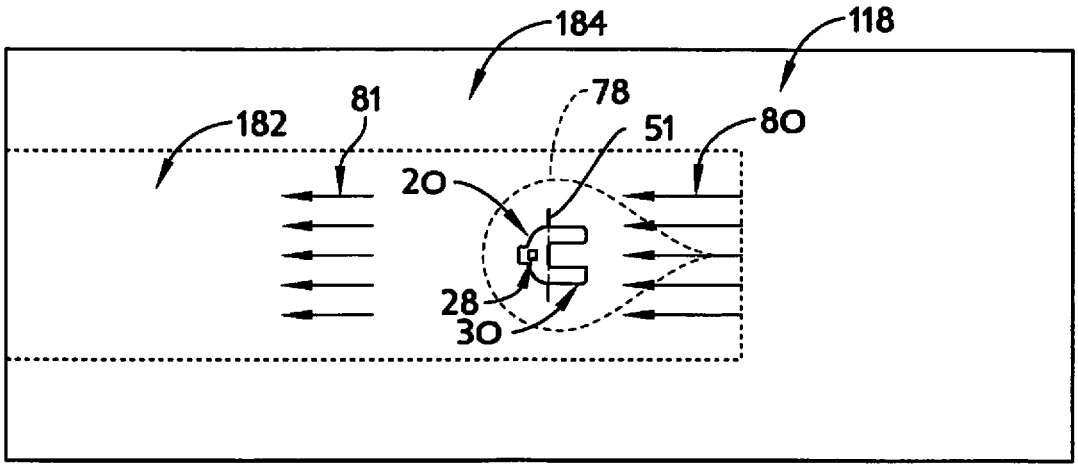
FIG. 12 is a view similar to FIGS. 9-11 for another embodiment of the support surface showing a sensor unit included in the support surface arranged to underlie a patient's pelvic region.
Figure 13:
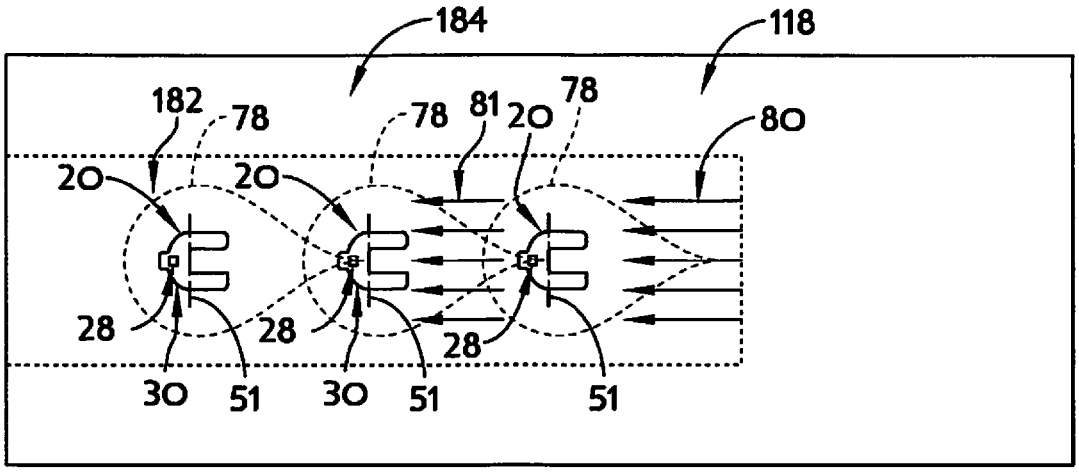
FIG. 13 is a view similar to FIGS. 9-12 for another embodiment of the support surface with three moisture sensor unit included in the support surface arranged to underlie a patient's pelvic region and torso region.

In FIGS. 12-13, alternative embodiments including sensor unit(s) 20 coupled to an alternative topper 118 are shown. Particularly, FIG. 12 shows a single sensor unit 20 arranged to detect moisture under a patient's pelvic region. FIG. 13 shows an alternative arrangement similar to the arrangement in FIG. 12 with three sensor units 20 arranged in a line to detect moisture under a patient's pelvic region and a patient's torso region. The alternative topper 118 shown in FIGS. 12 and 13 is configured to include an actively cooled region 182 and a passively cooled region 184. The sensor(s) 28 of sensor unit(s) 20 are illustratively arranged over the actively cooled region 182 of the alternative topper 118.

In the alternative topper 118, air provided by the air box 16 is introduced into the actively cooled region 182 at origination points 80, 81 adjacent to a patient's pelvic region and a patient's torso region. The passively cooled region 184 is pneumatically separated from the actively cooled region 182 and air flow in the passively cooled region 184 is driven by temperature differences between a patient's body overlaying the topper 118. The alternative topper 118 is further described in U.S. Application No. 61/770,704 filed Feb. 28, 2013, which is hereby incorporated in its entirety by reference herein.

The support bladders 60 are illustratively vertically-oriented column-shaped bladders as shown in FIG. 7. The bladders 60 are configured be inflated or deflated to increase or decrease the firmness of the support surface under different parts of a patient laying on the support surface 14. In some embodiments, pressure in individual support bladders 60 may be adjusted by the controller 70 in response to moisture information received from the sensor unit(s) 20.

Figure 14:
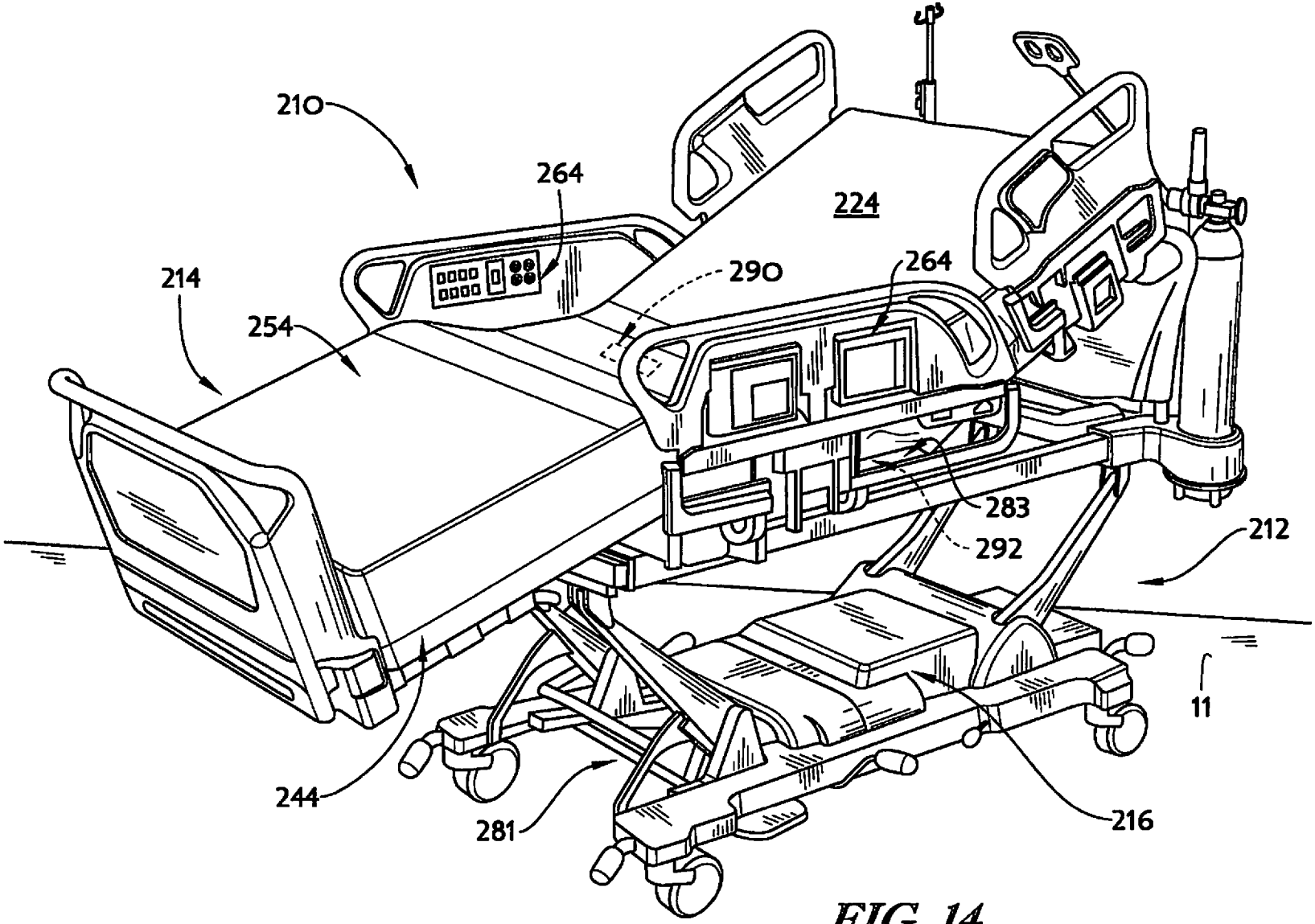
FIG. 14 is a perspective view of an alternative patient support apparatus in which the air box is integrated into the frame and in which a passive wireless sensor is arranged along a top side of a support surface to underlie a patient's pelvic region.

An alternative patient support apparatus 210 is shown in FIG. 14. The patient support apparatus 210 is substantially similar to the patient support apparatus 10 shown in FIGS. 1-3 and 7-9 which is described herein. Accordingly, similar reference numbers in the 200 series (e.g., reference numbers 244, 246, 254, 255, 258, 266, 272, 273 and 281) indicate features that are common between the patient support apparatus 10 and the patient support apparatus 210. The description of the patient support apparatus 10 is hereby incorporated by reference to apply to the patient support apparatus 210 except where it conflicts with the description and drawings of the patient support apparatus 210.

Figure 15:
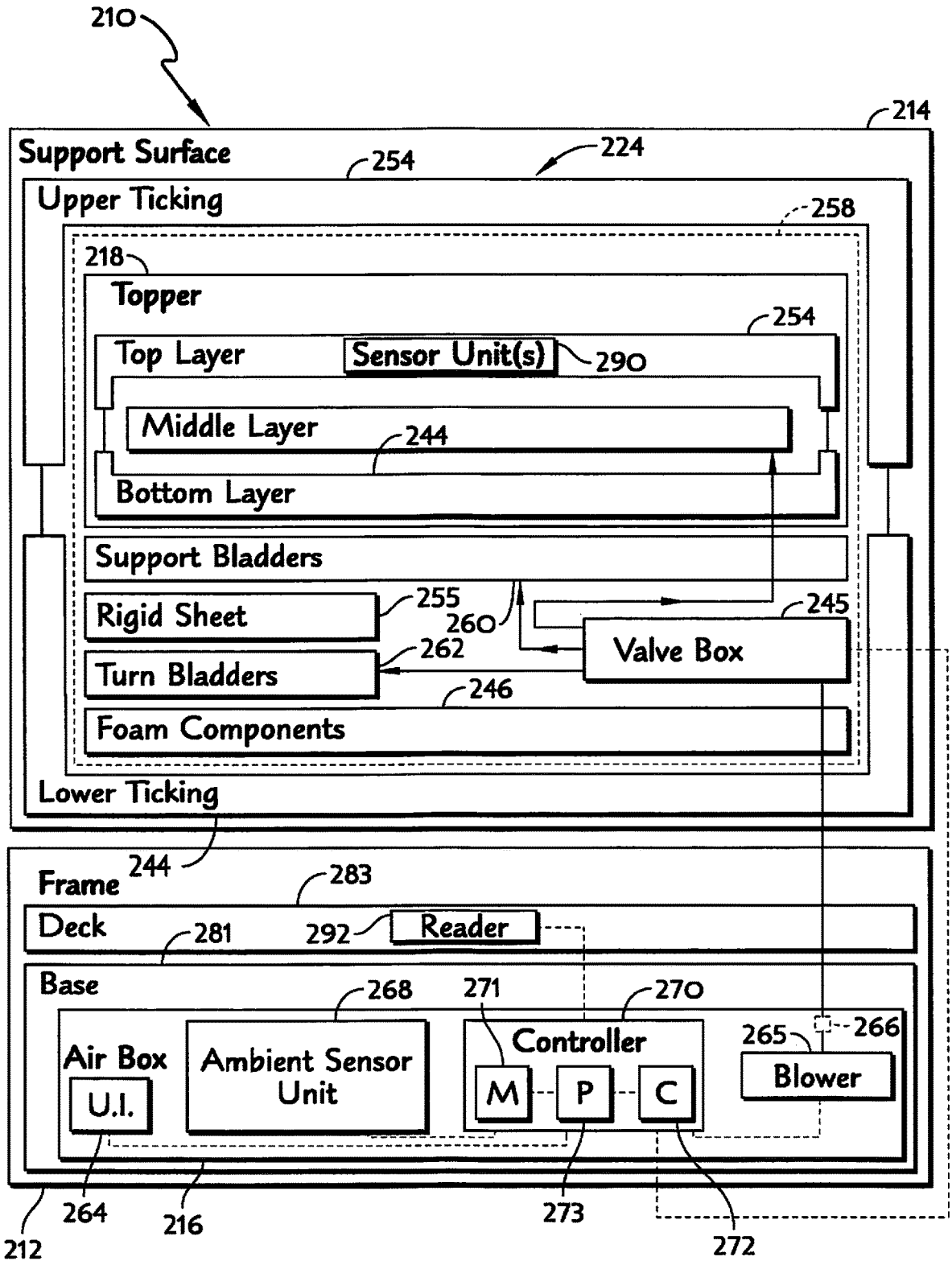
FIG. 15 is a diagrammatic view of the alternative patient support apparatus of FIG. 14 showing that frame includes a reader incorporated into a deck that underlies the passive wireless sensor included in the support surface.

Unlike the patient support apparatus 10, the patient support apparatus 210 includes a wireless sensor unit 290 rather than a sensor unit 20 as shown in FIGS. 14 and 15. The sensor unit 290 is illustratively adhered to the top layer 254 of the topper 218 to detect moisture levels on the patient support apparatus 10 near a patient's skin, for example from sweat or incontinence. In some embodiments, the sensor unit 290 may also (or alternatively) detect temperature near the patient's skin.

The wireless sensor unit 290 is illustratively a passive sensor that is not wired for power and does not include an internal power source. Rather, the sensor unit 290 is powered wirelessly by a reader 292 incorporated into the frame 212 underlying the support surface 214 as shown in FIGS. 14 and 15.

The reader 292 is illustratively integrated into the deck 283 of the frame 212 and is arranged to underlie the wireless sensor unit 290. The reader 292 is coupled to the controller 270 for communication with the controller 270 included in the air box 216. The reader 292 is configured to wirelessly power the wireless sensor unit 290 and to receive moisture data from the wireless sensor unit 290 while the patient support apparatus 10 is in use.

The air box 216 is illustratively integrated with the frame 212, as shown in FIGS. 14 and 15, but in some embodiments may be independent of the frame 212 as suggested in FIG. 1. Aside from integration with the frame 212, the air box 216 is similar to air box 16 and provides air to the topper 218 along with pressure control air to the inflatable bladders included in the support surface 214.

As discussed with regard to controller 70 herein, controller 270 is configured to adjust operation the bed based on data from sensors located along the top side 224 of the support surface 214 and spaced apart from the support surface 214. In particular, the controller 270 receives moisture data (and sometimes temperature data) corresponding to conditions adjacent to a patient's skin from the wireless sensor unit 290 and moisture data (and sometimes temperature data) corresponding to atmospheric conditions from the ambient sensor unit 268. Based on the received data, the controller 270 determines a risk level for developing bed sores.

If the risk level exceeds one or more predetermined thresholds stored in the memory 271, the controller 270 takes one or more corresponding corrective actions. Corrective actions may include displaying an alert on the user interface 264, sending an alert to a caregiver via a nurse call (or similar) system, and/or adjusting the operation of the blower 265 and the valve box 245 to increase air flow through the topper 218, to change the pressure in the support bladders 260, and/or to start lateral rotation of the patient using the turn bladders 262.

Although certain illustrative embodiments have been described in detail above, variations and modifications exist within the scope and spirit of this disclosure as described and as defined in the following claims.

The invention claimed is:

1. A method of using a sensor with a mattress, the method comprising: providing a cushion, providing a cover having an upper portion overlying the cushion and configured to support a patient, the upper portion of the cover including a slit, providing a sensor unit including a sensor coupled to and proximate a base of a flexible mount which is configured to secure the sensor to the upper portion of the cover, the flexible mount having a retention portion and an elongated stem portion having a plurality of extensions, each of the extensions extending from first ends at opposite sides of said base to distal ends remote from said base, the stem portion having a length which extends beyond the extensions, and inserting the stem portion through the slit and underneath the upper portion of the cover so that the retention portion resides above the upper portion of the cover so as to prevent the sensor from being slid beneath the cover.

2. The method of claim 1, wherein inserting the stem portion through the slit comprises inserting the stem portion through the slit so that the retention portion engages the cover along the slit to retain the sensor of the sensor unit in place relative to the cover.

3. The method of claim 2, wherein the retention portion is U-shaped.

4. The method of claim 2, wherein the retention portion is V-shaped.

5. The method of claim 2, wherein the retention portion is triangular.

6. The method of claim 1, wherein the flexible mount includes a flexible film and a circuit coupled to the flexible film to provide an electrical path from the sensor.

7. The method of claim 1, wherein providing the cover having the upper portion comprises providing the cover with the upper portion including a top layer, a middle layer, and a bottom layer, and with the slit being formed to extend through the top layer of the upper portion.

8. The method of claim 7, wherein the middle layer includes a three-dimensional material configured to conduct air between the top layer and the bottom layer.

9. The method of claim 8, further comprising forcing air through the three-dimensional material of the middle layer.

10. The method of claim 7, further comprising providing an air box coupled to the cover and configured to provide air to the middle layer of the cover.

11. The method of claim 7, further comprising providing a blower coupled to the middle layer of the cover and providing a controller, the controller being coupled to the blower and the sensor unit, and the controller being configured to adjust operation of the blower based on information from the sensor unit.

12. The method of claim 1, wherein the cushion includes a plurality of inflatable bladders, and further comprising providing an air box including a blower coupled to the plurality of inflatable bladders and providing a controller, the controller being coupled to the sensor unit and the blower, and the controller being configured to adjust operation of the blower based on information from the sensor unit.

13. The method of claim 1, wherein inserting the stem portion through the slit results in the sensor unit being positioned atop a central portion of the cover between a head end and a foot end of the cover so that the sensor unit is arranged to underlie the pelvic region of a patient.

14. The method of claim 1, wherein providing the cushion comprises providing at least one support bladder and providing at least one turn bladder.

15. The method of claim 14, wherein providing the at least one support bladder comprises providing a plurality of support bladders and wherein providing at least one turn bladder comprises providing a left turn bladder and a right turn bladder.

16. The method of claim 14, wherein providing the at least one turn bladder comprises providing the at least one turn bladder beneath the at least one support bladder.

17. The method of claim 1, further comprising providing a valve box inside of the mattress.

18. The method of claim 1, further comprising using the sensor to sense moisture.

19. The method of claim 1, further comprising using the sensor to sense incontinence of a patient.

20. The method of claim 1, further comprising using the sensor to sense sweat from a patient.

* * * * *